United States Patent [19]

Lanin et al.

[11] 4,129,264

[45] Dec. 12, 1978

[54] SOUNDPROOF HOPPER

[76] Inventors: Semyon Lanin, 330 Wadsworth Ave., Apt. 6F, New York, N.Y. 10040; Jackob Lanin, 288 Dunhams Corner Rd., East Brunswick, N.J. 08816

[21] Appl. No.: 833,310

[22] Filed: Sep. 14, 1977

[51] Int. Cl.[2] ..... B02C 23/00; G10K 11/04

[52] U.S. Cl. ..... 241/285 R; 181/200; 193/2 R; 222/131

[58] Field of Search ..... 193/2 R, 3; 241/285 R; 181/200, 205; 222/131

[56] References Cited

U.S. PATENT DOCUMENTS

| | | | |
|---|---|---|---|
| 3,643,880 | 2/1972 | Peterson | 241/285 R |
| 3,901,349 | 8/1975 | DeNoyer | 241/285 R |

*Primary Examiner*—Robert W. Saifer
*Assistant Examiner*—Jeffrey V. Nase

[57] ABSTRACT

A soundproof hopper for a comminuting machine having an inner hopper mounted to the comminuting machine and an outer hopper loosely supported by the inner hopper. The space between the inner hopper and the outer hopper contains soundproofing material.

8 Claims, 1 Drawing Figure

SOUNDPROOF HOPPER

BACKGROUND OF THE INVENTION

This invention relates to an arrangement for reducing noise of a machine with a hopper (for crushing, chipping, cutting), or more particularly to a soundproof hopper. In present time hoppers that have to be made from steel sheets radiate more noise than the machine itself, which makes the use of total enclosures widespread. Total enclosures make the machine immobile and associated with a loss of visibility, accessibility and increase in production cost. Although these total enclosures reduce the overall noise of the machine, the worker which loads the machine works in the noisiest place, because the vibrating neck of the hopper radiates noise near and through its opening. The doors of these hoppers have to open to the inside to let the material being loaded through. However, under negative pressure inside the hopper of the working machine these doors open and radiate even more noise.

The use of foam material as a support and vibration isolator as well as an acoustic seal does not prevent noise from leaking through boundary cracks because sound absorbtive foam is not a noise barrier, although it is mistakingly used as such. Another disadvantage of foam material is that with time it shrinks under weight.

SUMMARY OF THE INVENTION

In accordance with the invention the hopper consists of an inner hopper, an outer hopper, a chute and an apron. The outer hopper hangs structurally free, which prevents the exit of most of the airborne and structure borne noise radiating from the based on the machine inner hopper. Radiation of noise from the opening of the hopper is prevented by a chute with a door, which is freely placed into the outer hopper and does not transmit most vibrations from it. The apron freely hangs on the outer hopper, so that most of the vibrations do not transmit to it, and covers the noisiest parts of the machine. In this manner vibrations successfully attenuate in transmission to the outer hopper and, in addition, also in transmission to the chute to the apron.

The opening of the chute is distant from the opening of the inner hopper and the machine itself, which creates a quiet working place for loading machine.

The passage of air inside the hopper is accomplished through the space between the outer hopper and the inner hopper, and through perforations in the wall of the inner hopper. This construction prevents the opening of doors in the hoppers induced by the negative pressure inside the inner hopper and the working machine, in case of pneumatic transportation.

In order to prevent the foam on which the outer hopper can rest from shrinking under the weight of the outer hopper, the latter can also simultanuously rests on a resiliant material cushion which can be located on a shelf of a pin. The pin is fastened onto the inner hopper and fixes the outer hopper in place; it also serves as a hook lift.

In order to reduce the vibration of the housings of the hoppers and prevent them from resonance, pieces of MPM (metal-plastic-metal) material are welded onto the outer surface of the inner hopper and the inner surface of the outer hopper.

BRIEF DESCRIPTION OF THE DRAWING

Further objects and advantages of invention will become more apparent from the following description and claims, and from the accompanying drawing wherein

DETAILED DESCRIPTION OF THE PREFERRED EMBODIMENT

Figure 1:
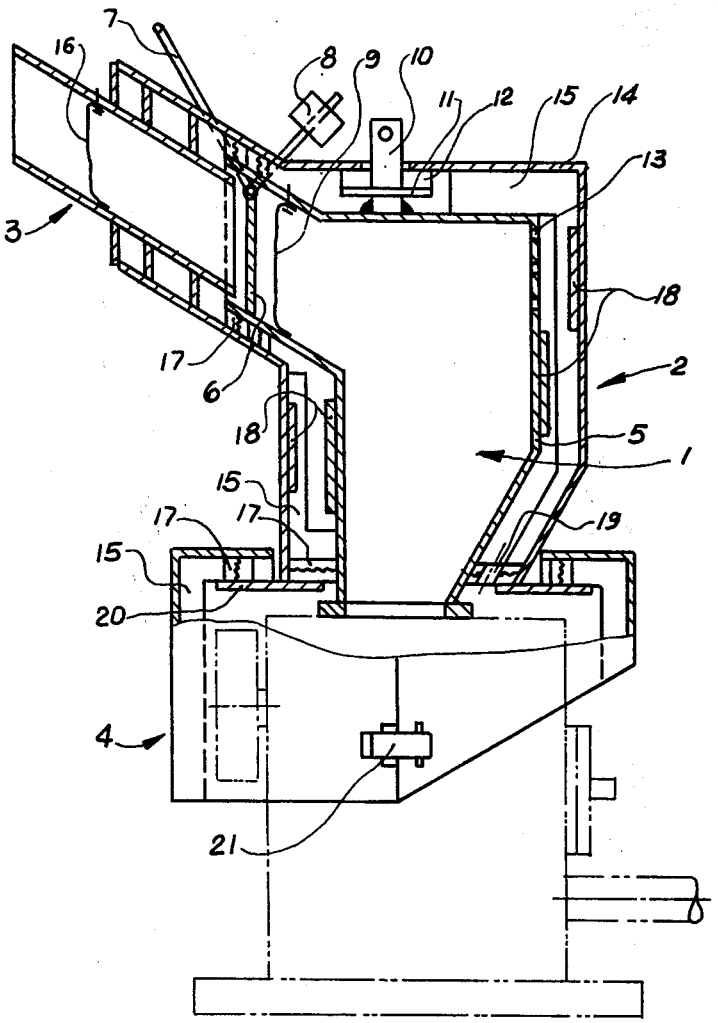
FIG. 1 is a simplified cross section of a soundproof hopper.

In FIG. 1 an inner hopper, an outer hopper, a chute and an apron are shown, generally indicated as 1, 2, 3, 4 respectively. Inner hopper 1 is fastened to the machine and consists of housing 5, door 6 with handle 7 and counterweight 8, door 9, pin 10 with shelf 11, resilient material 12, and perforations 13.

The doors 6 and 9 are opened with the help of handle 7 so that the material can be loaded into the machine, which is shown in phantom lines. Air enters into the inner hopper 1 through perforations 13, in order that under negative pressure air does not enter through the doors and they stay tightly closed.

Rectangular pin 10 which is located in the center of gravity of the hopper, together with shelf 11 and resilient material fixes in place and supports part of the weight of outer hopper 2.

Outer hopper 2 freely hangs on the inner hopper 1 and receives only a part of the vibrations of the inner hopper only in the place of suspension. The outer hopper 2 consists of housing 14, plain foam material 15 and foam material 17 with a layer of noise barrier material. Foam material 15 is glued onto the inner surface of the outer hopper 14 and prevents noise build up in the space between the inner hopper 5 and the outer hopper 14 and serves as a support for part of the weight of the outer hopper 2.

As it is shown in the drawing, the weight of the outer hopper 2 is divided between soft resilient foam material 15 and firm resilient material 12. A soft and reliable support for the outer hopper 2 in given position, which prevents transmission of most vibrations, results.

Welded on the walls of the hopper MPM plates 18, which can be of any contour (scrap can be used because the plates can not be seen) prevent resonance and reduce vibration of the walls of hoppers. Openings 19 serve as a passage for air into the space between the two hoppers and complete the ventillation system mentioned earlier. The space between the two hoppers is long narrow, winding and ending with shelf 20, so that it forms a sound trap, which prevents the exit of noise.

Chute 3 with door 16 is freely placed into the elongated neck of the outer hopper 2, which prevents transmission of structure borne noise. The opening of the chute 3 is distant from the opening of the inner hopper 1 and the machine itself. Exit of airborne noise radiated by the machine is prevented by doors 6 and 9. The airborne noise radiated by the inner hopper 1 is prevented from exitting by door 16. This construction of chute 3 reduces the noise of the machine as a whole and creates a quiet working place for loading the machine.

Apron 4 is freely suspended on shelf 20 of the outer hopper 2 with foam material 15 and 17 between them. Most vibrations do not transfer from outer hopper 2 to apron 4 and vice versa. Foam material 17 with a layer of noise barrier material seals the boundary cracks against sound leakage. This can not be achieved using noise absorbtive foam. Apron 4 consists of two parts connected by clamps 21 and serves as a noise barrier for the noisiest parts of the machine itself.

The authors of the invention using this hopper succeeded to reduce the noise of the machine from 105 dBA down to 78dBA, something that was never accomplished before, even using total enclosures.

We claim:

1. A soundproof hooper for a machine for comminuting material comprising an inner hopper mounted on said comminuting machine, an outer hopper enclosing said inner hopper, means for loosely supporting said outer hopper on said inner hopper so that said outer hopper is free to move with respect to said inner hopper and said comminuting machine, said means for loosely supporting said outer hopper including resilient material on which said outer hopper rests on said inner hopper and means for soundproofing said inner hopper located between said inner hopper and said outer hopper.

2. A soundproof hopper in accordance with claim 1, wherein said outer hopper loosely supports a soundproof apron which surrounds part of the comminuting machine.

3. A soundproof hopper in accordance with claim 1, wherein said means for loosely supporting said outer hopper includes an opening in the outer hopper and a pin fastened to the inner hopper which penetrates said opening and holds the outer hopper in place.

4. A soundproof hopper in accordance with claim 1 including a chute for feeding material to the inner hopper and means for loosely supporting the chute on said outer hopper.

5. A soundproof hopper according to claim 4 including a moveable curtain in said chute.

6. A soundproof hopper according to claim 1 including a door in said inner hopper.

7. A soundproof hopper according to claim 6 including a moveable curtain in said inner hopper.

8. A soundproof hopper in accordance with claim 1, wherein pieces of MPM (metal-plastic-metal) material are welded onto the outer surface of the inner hopper and the inner surface of the outer hopper.

* * * * *